US006212812B1

(12) United States Patent
Aigner

(10) Patent No.: US 6,212,812 B1
(45) Date of Patent: Apr. 10, 2001

(54) PISTOL WITH TRIGGER LOCKING MECHANISM

(75) Inventor: Friedrich Aigner, Valentin (AU)

(73) Assignee: Steyr Mannlicher AG & Co. KG, Vienna (AU)

( * ) Notice: Subject to any disclaimer, the term of this patent is extended or adjusted under 35 U.S.C. 154(b) by 0 days.

(21) Appl. No.: 09/352,394

(22) Filed: Jul. 13, 1999

(30) Foreign Application Priority Data

Jul. 14, 1998 (AU) ..... GM 478/98

(51) Int. Cl.[7] ..... F41A 17/00
(52) U.S. Cl. ..... 42/70.06
(58) Field of Search ..... 42/70.06, 70.04, 42/70.11, 70.07

(56) References Cited

U.S. PATENT DOCUMENTS 3,979,850 * 9/1976 Schiessl et al. ..... 42/71
4,754,568 * 7/1988 Brandt ..... 42/70.06
5,042,185 * 8/1991 Justice, Sr. ..... 42/70.11
5,241,769 * 9/1993 Von Muller ..... 42/70.11
5,361,525 * 11/1994 Bowes ..... 42/70.11
5,371,965 * 12/1994 Nelson ..... 42/70.07
5,638,627 6/1997 Klein et al. .
5,659,993 * 8/1997 Watson, Jr. et al. ..... 42/70.04
5,671,560 * 9/1997 Meller ..... 42/70.11

FOREIGN PATENT DOCUMENTS 1703217 3/1972 (DE) .

OTHER PUBLICATIONS

NRA. . . Illustrated Firearms Assembly Handbook. "Colt.25 Pocket Automatic", Triggs, James M. Jul. 1960.*

* cited by examiner

*Primary Examiner*—Charles T. Jordan
*Assistant Examiner*—Christian M. Best
(74) *Attorney, Agent, or Firm*—Bachman & LaPointe, P.C.

(57) ABSTRACT

A pistol comprises a butt containing a trigger mechanism and a barrel slide which can be displaced in the longitudinal direction, the trigger being guided in the upper part of the butt. In order to permit rapid, simple and reliable locking and unlocking, a locking pin is guided so that it can be displaced and rotated in a lateral transverse hole in the butt. The locking pin protrudes into the path of the trigger in the locked condition. A compression spring acts on the locking pin in the unlocked position and the locking pin has a head which interacts in bayonet fashion with an enlarged portion of the hole so that two different angular positions of the locking pin correspond to the locked and unlocked positions are selected.

7 Claims, 7 Drawing Sheets

PISTOL WITH TRIGGER LOCKING MECHANISM

BACKGROUND OF THE INVENTION

The present invention relates to a pistol, which comprises a butt containing a trigger mechanism and a barrel slide which can be displaced in the longitudinal direction. The trigger is guided in the upper part of the butt.

As a result of repeatedly occurring accidents and incidents in which children or young people make unauthorized use of firearms, there is a requirement to make access to firearms more difficult. This requirement to an increasing extent comes from the legislature. Storage of pistol in cabinets which can be locked, which is usual in the case of long weapons, is not customary as, in the case of pistols, they are often stored in desks or bedside cabinets. The usual solution is, therefore, to provide additional mechanisms enclosing and filling the trigger guard and these are secured by means of a lock and thus making movement of the trigger impossible.

DESCRIPTION OF THE PRIOR ART

Such mechanisms are known from DE-A 17 03 217 and U.S. Pat. No. 5,638,627, with a cylinder lock in the first publication and a combination lock in the second. They are, of course, just as suitable for long weapons as for pistols.

In any event, they involve bulky additional items which do not usually fit very accurately and are, in addition, expensive. Furthermore, unlocking the mechanisms requires some time and skill, which is not always available. In pistols of the generic type, there is a further safety problem which involves the (almost invariably present) stripping lever, which may collide with one of the additional mechanism discussed above and thus cause an undesired stripping of the pistol. This risk is present even without any additional mechanism.

SUMMARY OF THE INVENTION

It is a principle object of the invention to improve a pistol of the generic type in such a way that, with a minimum of additional costs, rapid, simple and reliable locking and unlocking is possible thereby improving safety.

In accordance with the invention, the foregoing object is achieved wherein a locking pin is guided so that it can be displaced and rotated in a lateral transverse hole of the butt. The locking pin protrudes into the path of the trigger in the locked condition. A compression spring acts on the locking pin in the opening direction. The locking pin has a head which interacts in bayonet fashion with a hole in a side wall of the butt so that two different angular positions of the locking pin correspond to two travel positions, locked and unlocked.

The locking of the trigger therefore takes place within the butt where, even in the case of a small pistol, there is still space to accommodate a transverse hole and the locking pin. As a result, the locking pin comes to lie in the vicinity of the trigger where it is easily accessible and easy to operate. Because of the bayonet-type interaction between the head and the hole, the two travel positions (locked, unlocked) can be established with minimum space requirement. The accurate arrangement, length and support of the pin and the arrangement of the spring can then be easily adapted to the features of the particular weapon. Finally, only one additional and quite simple component is necessary.

In an embodiment which is preferred because it is particularly space-saving and cheap, the head of the locking pin has at least one lug on its outer periphery and the side wall of the butt has at least one recess on the inside and on the periphery of the hole, which recess accepts the lug in the open position.

Within the scope of the invention, the recess can extend over the whole thickness of the side wall and the lug has a colored mark on its side facing toward the outside. As a result, it is possible to recognize visually whether the weapon is locked or not.

In an advantageous further development, a pistol with a stripping lever which can be pivoted about a transverse axis, which is almost always the case in pistols, the end of the stripping lever remote from the transverse axis partially overlaps the hole in the side wall and the head of the locking pin has on its outside a locking lug in which the end of the stripping lever engages when the locking pin is in the open position, so that the stripping lever is restrained. In this way, the stripping lever is restrained when the weapon is unlocked, i.e. ready to fire, so that it cannot be accidentally operated, which represents a safety risk. In order to strip the weapon, the pin must be pushed in slightly so that the stripping lever can be operated.

In order to facilitate the assembly of the pistol, the end of the stripping lever overlapping the hole can have a chamfer on its side facing toward the head of the locking pin. As a result, the stripping lever itself presses the pin slightly into the weapon and snaps in as soon as it has reached its end position.

There are various possibilities for the actual locking procedure. The simplest comprises that the head of the locking pin has, on the outside, a profiled opening for accepting a key. A somewhat more complicated, but particularly safe possibility, comprises that the locking pin accepts a locking cylinder of a cylinder lock.

BRIEF DESCRIPTION OF THE DRAWINGS

The invention is described and explained hereinbelow wherein.

DESCRIPTION OF THE PREFERRED EMBODIMENTS

Figure 1:
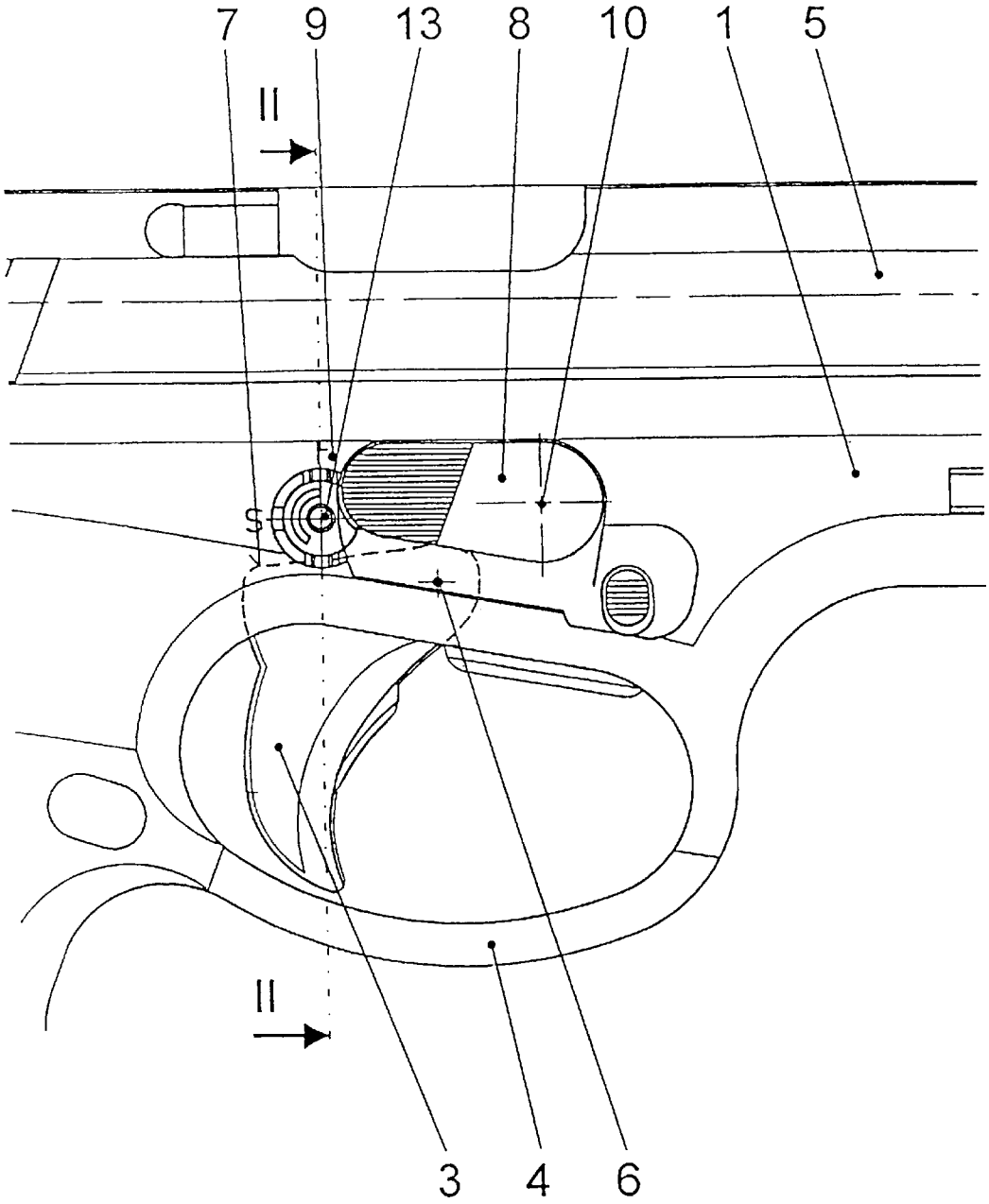
FIG. 1 shows a partial view of a pistol according to the invention.
Figure 2:
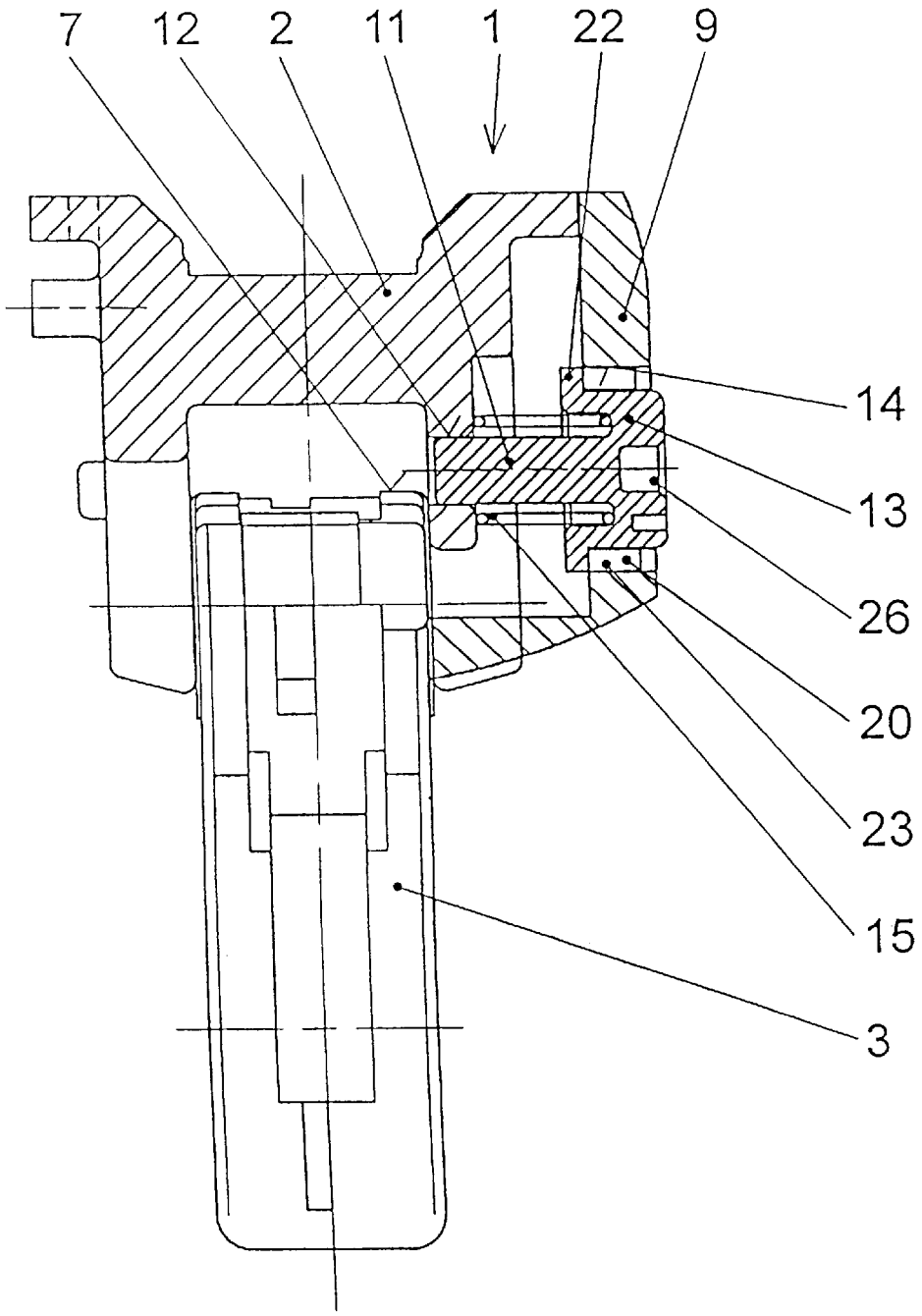
FIG. 2 shows an enlarged cross section at II—II, in a first position.

Only the central part of a pistol according to the present invention is shown in FIG. 1 and, in fact, essentially a butt 1, for example made of plastic, which contains within it a functional part 2 made of metal (see FIG. 2). A trigger 3 protrudes downward from the upper part of the butt 1 and this is surrounded by a trigger guard 4. A barrel slide 5 (the barrel itself is not visible) is guided so that it can be displaced above the butt 1. The trigger 3 is pivotably supported about an axis (center of rotation 6) within the butt 1 and possesses an upper edge 7, which is shown as a dashed line because it is invisible from the outside. Finally, a stripping lever 8 is also provided from which a rotating pin 10 (which is not visible) protrudes through a side wall 9 of the butt 1 to within the butt 1 and interacts there, in known manner, with the barrel slide 5.

Recognizable in FIG. 2 is a locking pin 11, which is rotatably supported in a transverse hole 12 of the butt 1, in particular of the functional part 2. The locking pin 11 has a head 13 which interacts in bayonet fashion with a hole 14 in the side wall 9 of the butt, as has still to be explained. The head 13 is pressed outward by a compression spring 15. A hole 26, of any desired shape and in which a corresponding key can be introduced to actuate the lock, is provided centrally in the head 13.

Figure 3:
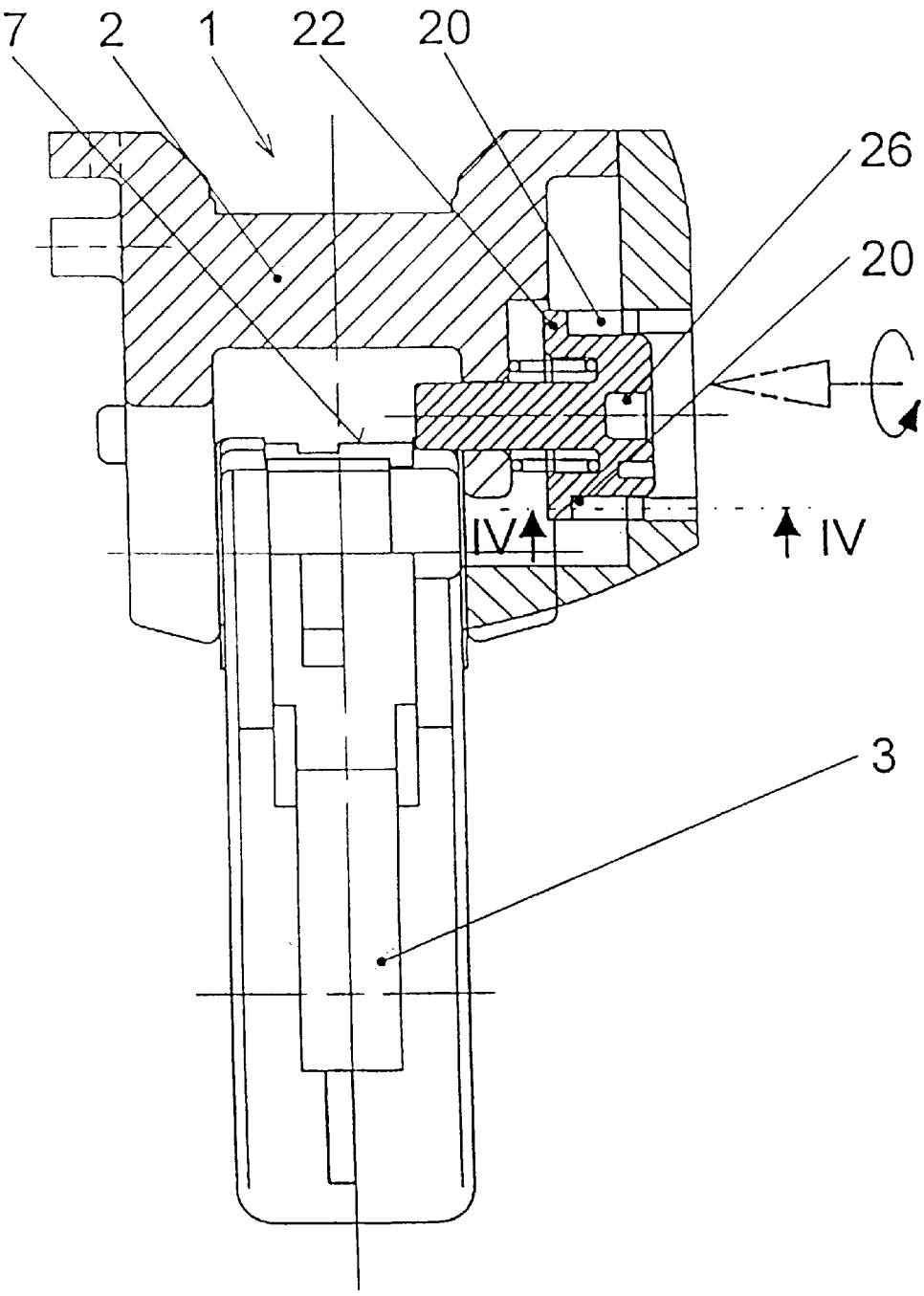
FIG. 3 shows an enlarged cross section at II—II, in a second position.
Figure 4:
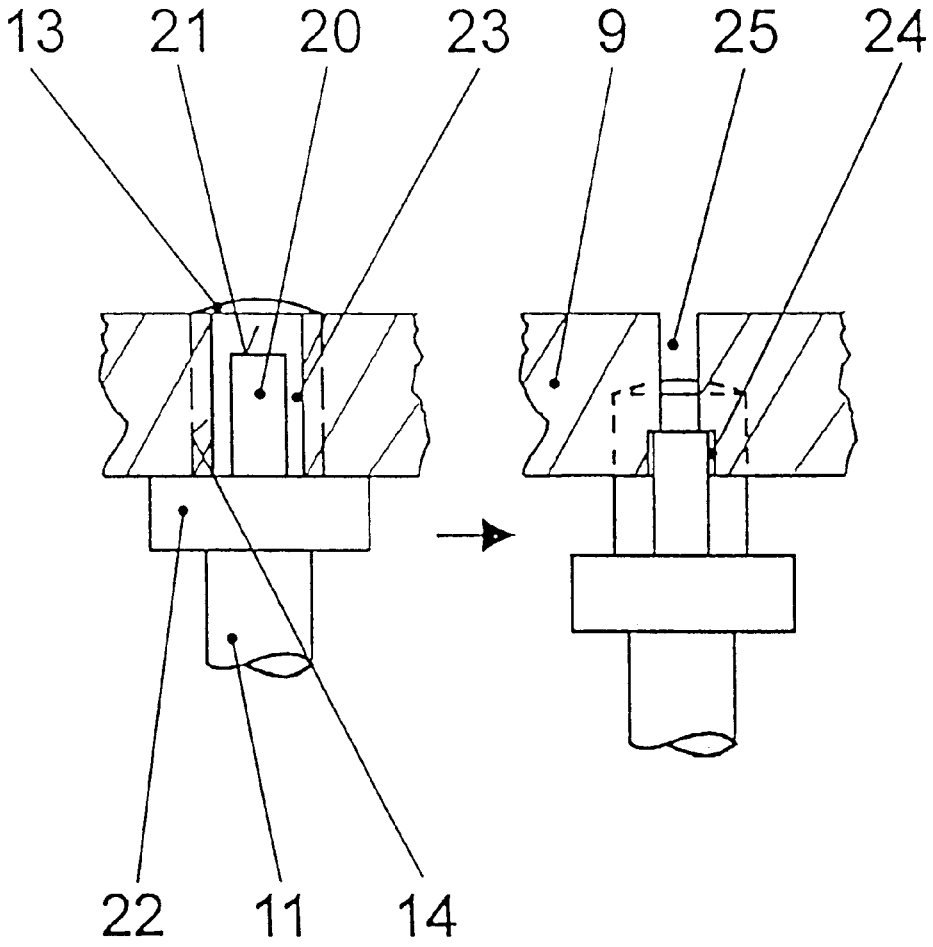
FIG. 4 shows a cross section at IV—IV, enlarged and developed.

In FIG. 3, the locking pin 11 is in the locked position. It protrudes to within the functional part 2 and acts as a stop for the upper edge 7 of the trigger. The bayonet-type interaction between the head 13 and the hole 14 is made clear by means of the diagrammatic FIG. 4, the head 13 being shown in the open position on the left-hand side and the same head being shown in the closed position on the right-hand side, FIGS. 2, 3 and 4 being viewed jointly. The head 13 has at least one lug 20 but preferably, as in the embodiment example shown, has two lugs offset by 180°. Their corner surface 21 pointing outward exhibits a red colored mark. Before merging into the locking pin 11, the cylindrical part of the head 13 is provided with a collar 22. In the side wall 9, there are two recesses 23, likewise offset by 180°, which extend over the whole thickness of the side wall 9. If, now, the head 13 is rotated until the lugs 20 are no longer opposite to the recess 23 but to a further and substantially shallower recess 24, this angular position is associated with another travel position of the pin 11, namely the locked position. The only purpose of the small opening 25 is to make the red part 21 of the lug visible from the outside. The further recess 24 is not necessary but is used for exact positioning in the locked position.

Figure 5:
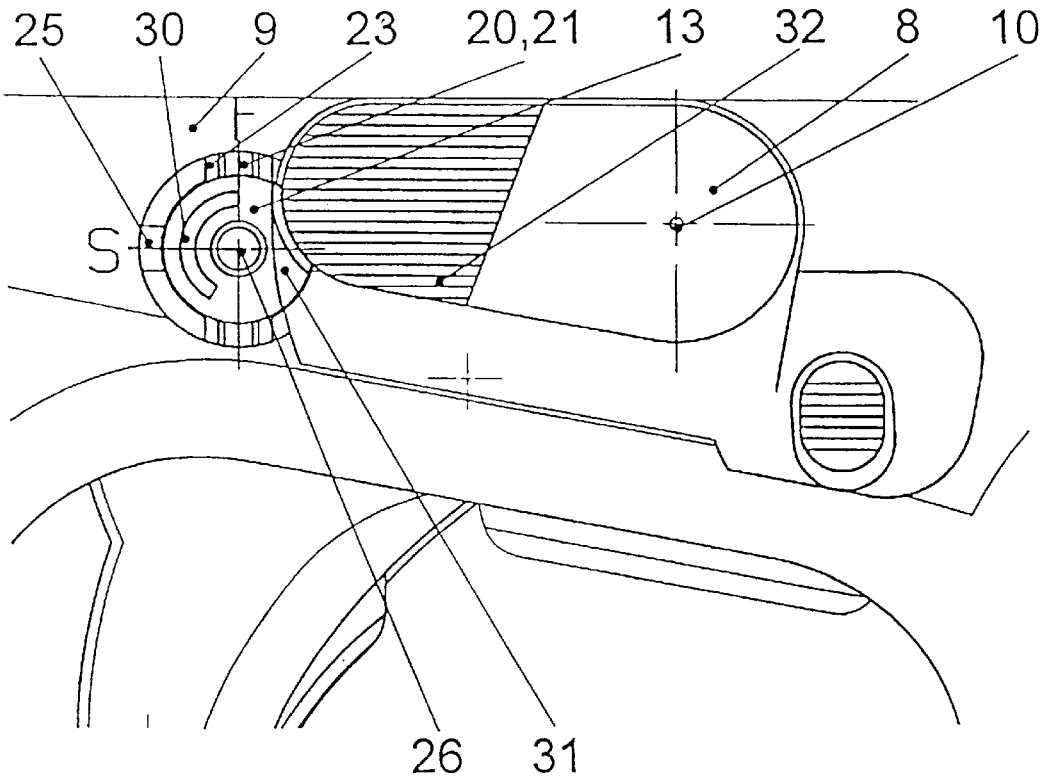
FIG. 5 shows an enlarged partial view in the first position.
Figure 6:
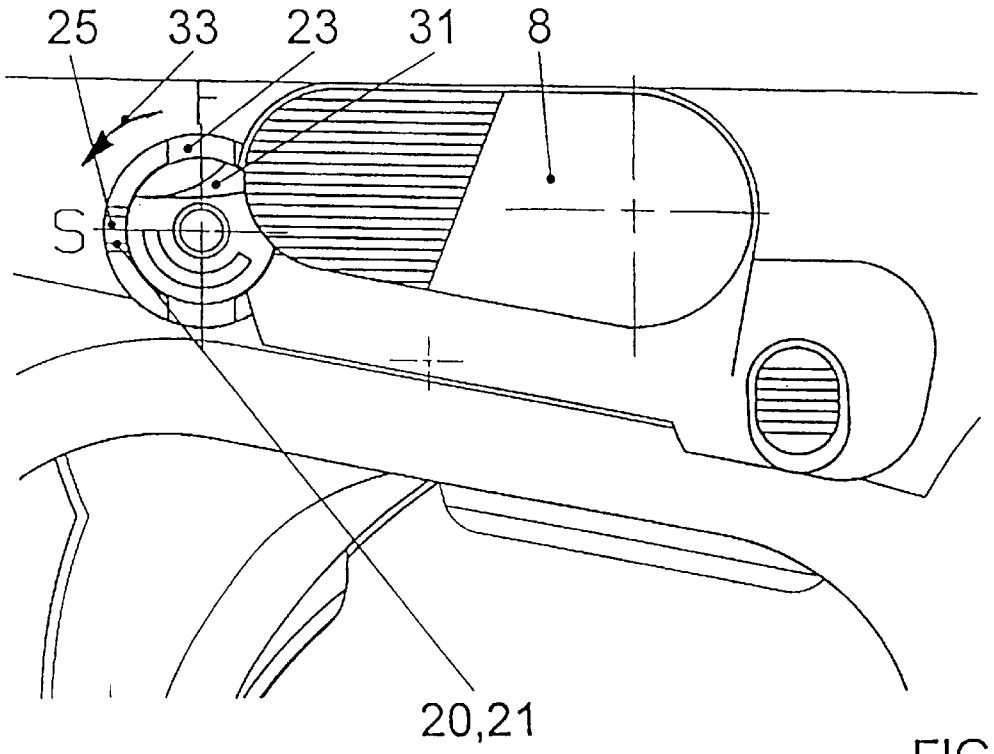
FIG. 6 shows an enlarged partial view in the second position.
Figure 7:
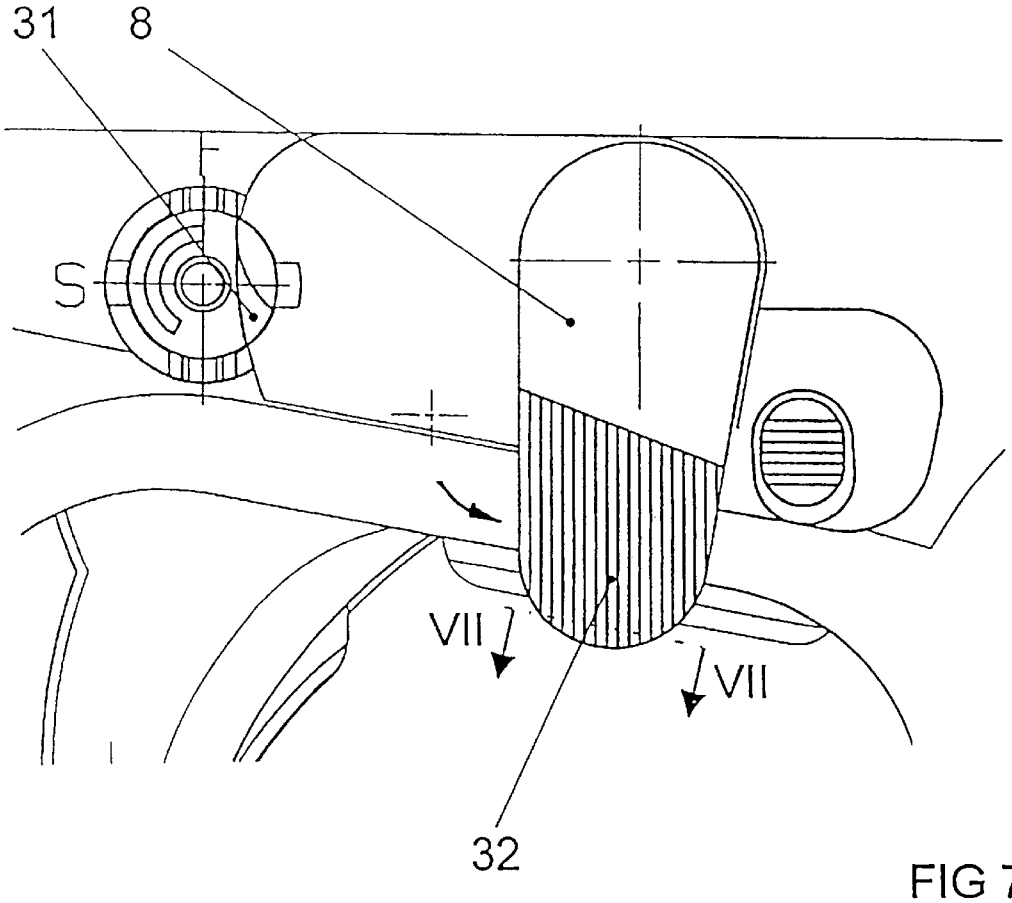
FIG. 7 shows an enlarged partial view in a third position.
Figure 8:
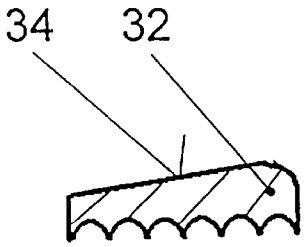
FIG. 8 shows a detail section at VII—VII of FIG. 7.

The mode of operation is now described using FIGS. 5, 6 and 7. In FIG. 5, the locking pin 11 is in the open position, see FIG. 2 and the left-hand illustration half of FIG. 4. The lugs 20 are engaged in the recesses 23 and exhibit their red surface 21 at the position at which an "F" is engraved on the outside of the side wall 9. If required for clarity, a colored strip 30 in the shape of a sector of an annulus can also be provided on the head 13. In addition, the head 13 also has a locking lug 31 which, in the open position shown, prevents the end 32 of the stripping lever 8 from being pivoted downward into the open position.

If a suitable key is now introduced into the opening 26 and, by means of this key, the locking pin is pressed inward and, for example, twisted anticlockwise by a right angle (arrow 33), the locked position of FIG. 6 is reached. The red colored mark 21 of the lug 20 now appears in the inspection opening 25 and shows the "S", which indicates the secured position. Because the locking pin 11 is pressed in, the lug 31 does not prevent downward pivoting of the stripping lever 8. The weapon cannot, however, be stripped in the locked position because the contact pin is in contact with the catch (not shown).

If, starting from the locked position, the weapon is to be stripped, FIG. 7, the locking pin 11 must be pressed in slightly in order to permit the stripping lever 8 to pivot downward. If the pistol is subsequently reassembled and, finally, the stripping lever 8 is pivoted upward again, there is no need to press the locking pin 11 inward again if the lower surface 34 of the end 32 of the stripping lever 8 is inclined. The oblique lower surface 34 then presses the locking pin 11 inward when it is pivoted upward and finally engages over the locking lug 31.

Figure 9:
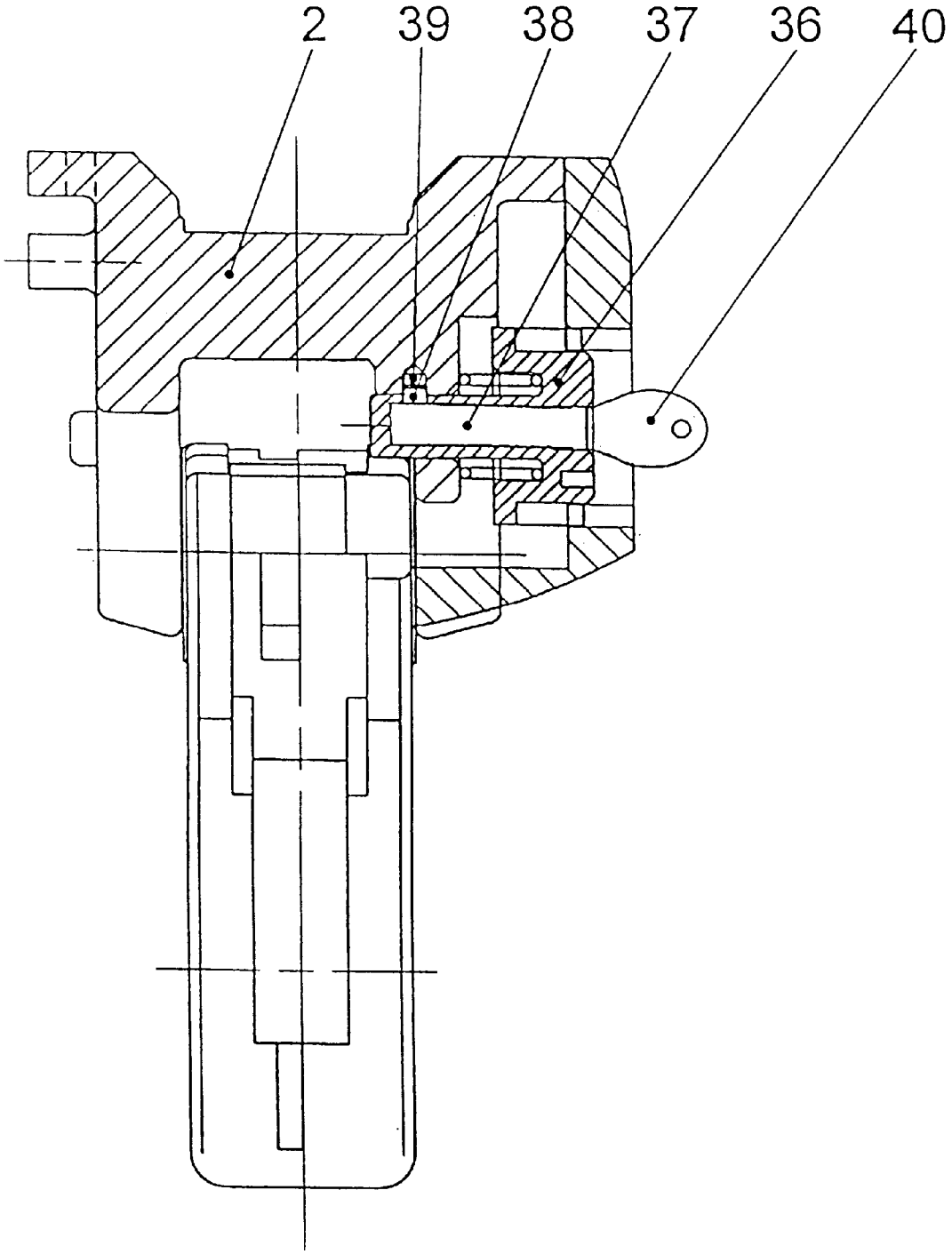
FIG. 9 shows a cross section of a variant, like FIG. 3.

It is possible to deviate from the embodiment shown in a variety of ways with respect to the length and support and arrangement of the locking pin 11, the accommodation of the spring 15 and also with respect to the actuation of the locking pin 11. In the variant of FIG. 9, a cylinder lock 37 is provided within the locking pin 36, its bolt engaging in a hole 39 in the functional part 2 in the locked condition. The cylinder lock 37 is locked by means of a key 40.

What is claimed is:

1. A pistol comprising a butt; a barrel slide mounted on the butt and longitudinally displaceable thereon; a trigger protruding from the butt; a laterally extending transverse hole in the butt proximate to a portion of the trigger; a locking pin mounted in the transverse hole and movable therein both in an axial and rotatable manner between a locked position wherein the locking pin protrudes into the path of the trigger and an unlocked position, said locking pin having a head portion; energy storage means acting on the head portion for biasing the locking pin to the unlocked position; the transverse hole includes an enlarged portion for receiving the head portion of the locking pin in bayonet fashion wherein the head portion and locking pin are axially and rotatably movable between two different angular positions and axial positions corresponding to the locked position and the unlocked position.

2. The pistol as claimed in claim 1, wherein the head of the locking pin has at least one lug on an outer periphery and a side wall of the enlarged portion has at least one recess on an inside periphery such that recess accepts the lug in the unlocked position of the locking pin.

3. The pistol as claimed in claim 2, wherein the recess extends over substantially the whole thickness of the side wall and the lug has a colored mark on its side facing toward the outside.

4. The pistol as claimed in claim 1, further including a stripping lever which is pivoted about a transverse axis, wherein an end of the stripping lever remote from a pivot axis of the lever partially overlaps the transverse hole in the side wall and wherein the head of the locking pin has a locking lug in which the end of the stripping lever engages when the locking pin is in the unlocked position, so that the stripping lever is restrained from pivotable movement.

5. The pistol as claimed in claim 4, wherein the end of the stripping lever overlapping the hole has a chamfered lower surface on a side facing toward the head of the locking pin.

6. The pistol as claimed in claim 1, wherein the head of the locking pin has a profiled opening for accepting a key.

7. The pistol as claimed in claim 6, wherein the locking pin includes means for accepting a locking cylinder of a cylinder lock.

* * * * *